US008029003B2

(12) United States Patent
Chen

(10) Patent No.: US 8,029,003 B2
(45) Date of Patent: Oct. 4, 2011

(54) SKATE WITH ADJUSTMENT UNIT

(76) Inventor: Wang-Chuan Chen, Taichung Hsien (TW)

( * ) Notice: Subject to any disclaimer, the term of this patent is extended or adjusted under 35 U.S.C. 154(b) by 393 days.

(21) Appl. No.: 12/404,368

(22) Filed: Mar. 16, 2009

(65) Prior Publication Data

US 2010/0230914 A1 Sep. 16, 2010

(51) Int. Cl.
*A63C 1/22* (2006.01)

(52) U.S. Cl. ..... 280/11.26; 280/11.221

(58) Field of Classification Search ..... 280/616, 280/11.16, 11.221, 11.12, 11.26, 11.27, 11.231, 280/11.19
See application file for complete search history.

(56) References Cited

U.S. PATENT DOCUMENTS

| | | | | |
|---|---|---|---|---|
| 2,497,175 | A * | 2/1950 | Mantos | 36/97 |
| 3,987,553 | A * | 10/1976 | Salomon | 33/562 |
| 4,684,140 | A * | 8/1987 | Olivieri | 280/11.26 |
| 5,184,352 | A * | 2/1993 | Maufette | 24/579.09 |
| 5,400,484 | A * | 3/1995 | Gay | 24/593.11 |
| 5,484,149 | A * | 1/1996 | Lee | 280/11.26 |
| 6,322,088 | B1 * | 11/2001 | Klamer et al. | 280/11.27 |
| 6,422,579 | B1 * | 7/2002 | Lindblad | 280/11.26 |
| 6,497,421 | B1 * | 12/2002 | Edgerley et al. | 280/11.19 |
| 6,547,261 | B2 * | 4/2003 | Gorza et al. | 280/11.223 |
| 6,574,888 | B2 * | 6/2003 | Miller et al. | 36/97 |
| 6,612,592 | B1 * | 9/2003 | Soo | 280/11.16 |
| 6,786,493 | B2 * | 9/2004 | Hong | 280/11.26 |
| 6,851,683 | B2 * | 2/2005 | Wegener | 280/11.26 |
| 6,918,601 | B2 * | 7/2005 | Sauter et al. | 280/11.26 |
| 6,918,602 | B2 * | 7/2005 | Lu | 280/11.26 |
| 6,932,360 | B2 * | 8/2005 | Wegener et al. | 280/11.16 |
| 7,137,635 | B2 * | 11/2006 | Haugen et al. | 280/11.26 |
| 7,144,018 | B1 * | 12/2006 | Chen | 280/11.221 |
| 7,152,865 | B2 * | 12/2006 | Chen | 280/11.26 |
| 7,175,186 | B2 * | 2/2007 | Lin | 280/11.26 |
| 7,246,803 | B2 * | 7/2007 | Sauter et al. | 280/11.26 |
| 7,314,222 | B2 * | 1/2008 | Borel et al. | 280/11.26 |
| 7,407,168 | B2 * | 8/2008 | Lee | 280/11.26 |
| 2002/0171210 | A1 * | 11/2002 | Sauter et al. | 280/11.221 |
| 2003/0094776 | A1 * | 5/2003 | Gorza et al. | 280/11.26 |
| 2004/0084861 | A1 * | 5/2004 | Wegener et al. | 280/11.16 |
| 2004/0094917 | A1 * | 5/2004 | Frigo et al. | 280/11.31 |
| 2004/0217562 | A1 * | 11/2004 | Haugen et al. | 280/11.221 |
| 2005/0057008 | A1 * | 3/2005 | Yiu Lu | 280/11.26 |
| 2006/0006616 | A1 * | 1/2006 | Sauter et al. | 280/11.221 |
| 2006/0091621 | A1 * | 5/2006 | Lin | 280/11.26 |
| 2008/0122201 | A1 * | 5/2008 | Furr et al. | 280/611 |

* cited by examiner

*Primary Examiner* — J. Allen Shriver, II
*Assistant Examiner* — Jacob Meyer
(74) *Attorney, Agent, or Firm* — Alan Kamrath; Kamrath & Associates PA

(57) ABSTRACT

A skate comprises a soleplate member including a heel support and a toe support overlapping and adapted to slide with respect to the heel support in a longitudinal axis and fixed in a desired position as to achieve a desired length of the soleplate member; wherein the toe support includes first and second teeth spaced from each other; and an adjustment unit including teeth adapted to selectively wedge with the first teeth and a wedging end adapted to selectively wedge with the second teeth.

13 Claims, 11 Drawing Sheets

SKATE WITH ADJUSTMENT UNIT

BACKGROUND OF THE INVENTION

1. Field of the Invention

The present invention generally relates to skates and more particularly to a skate having an adjustment unit adapted for adjusting size of soleplate of the skate.

2. Description of the Related Art

Both ice skating and in-line skating have been popular recreational activities for many years, especially for kids. However, kids have growing feet, and to enjoy skating the skates should properly fit the kids' feet. In order to accommodate the various foot sizes of many kids, many different sized skates must be purchased. And a conventional modifiable skate is usually not easy to adjust precisely. Thus, there is a need to provide a skate that can be modified in length, durable to the rigors that kids put skates through and also be simple for kids to use.

SUMMARY OF THE INVENTION

Aspects of the present invention address one or more of the issues mentioned above, thereby providing a skate that comprises a soleplate member including a heel support and a toe support overlapping and adapted to slide with respect to the heel support in a longitudinal axis and fixed in a desired position as to achieve a desired length of the soleplate member; wherein the toe support includes first and second teeth spaced from each other; and an adjustment unit including teeth adapted to selectively wedge with the first teeth and a wedging end adapted to selectively wedge with the second teeth.

Other objectives, advantages, and features of the invention will become more apparent from the following detailed description when taken in conjunction with the accompanying drawings.

BRIEF DESCRIPTION OF THE DRAWINGS

The present invention will be described via detailed illustration of the preferred embodiment referring to the drawings.

DETAILED DESCRIPTION OF THE PREFERRED EMBODIMENT

Figure 1:
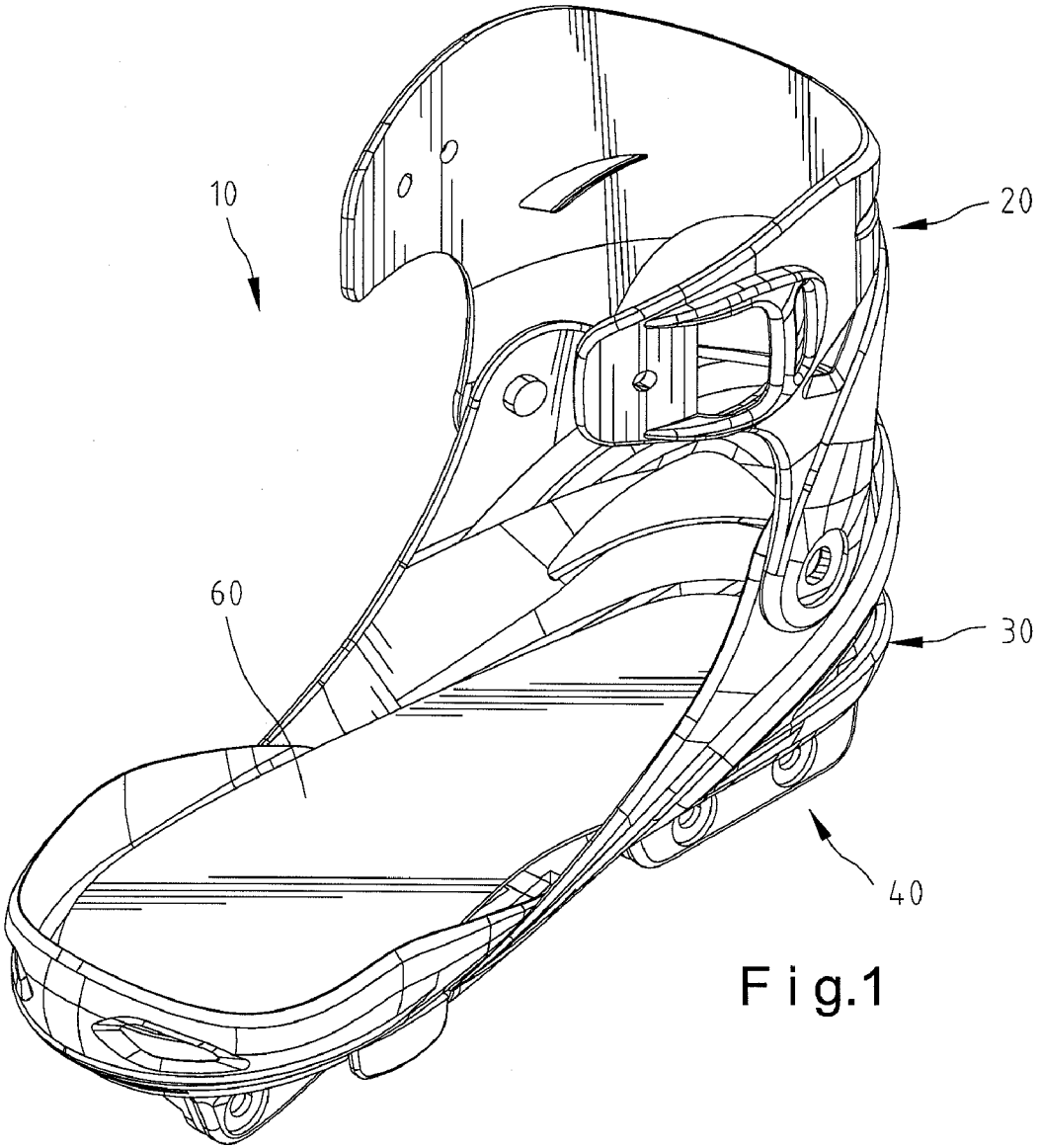
FIG. 1 is a perspective view of a skate according to the preferred embodiment of the present invention.
Figure 2:
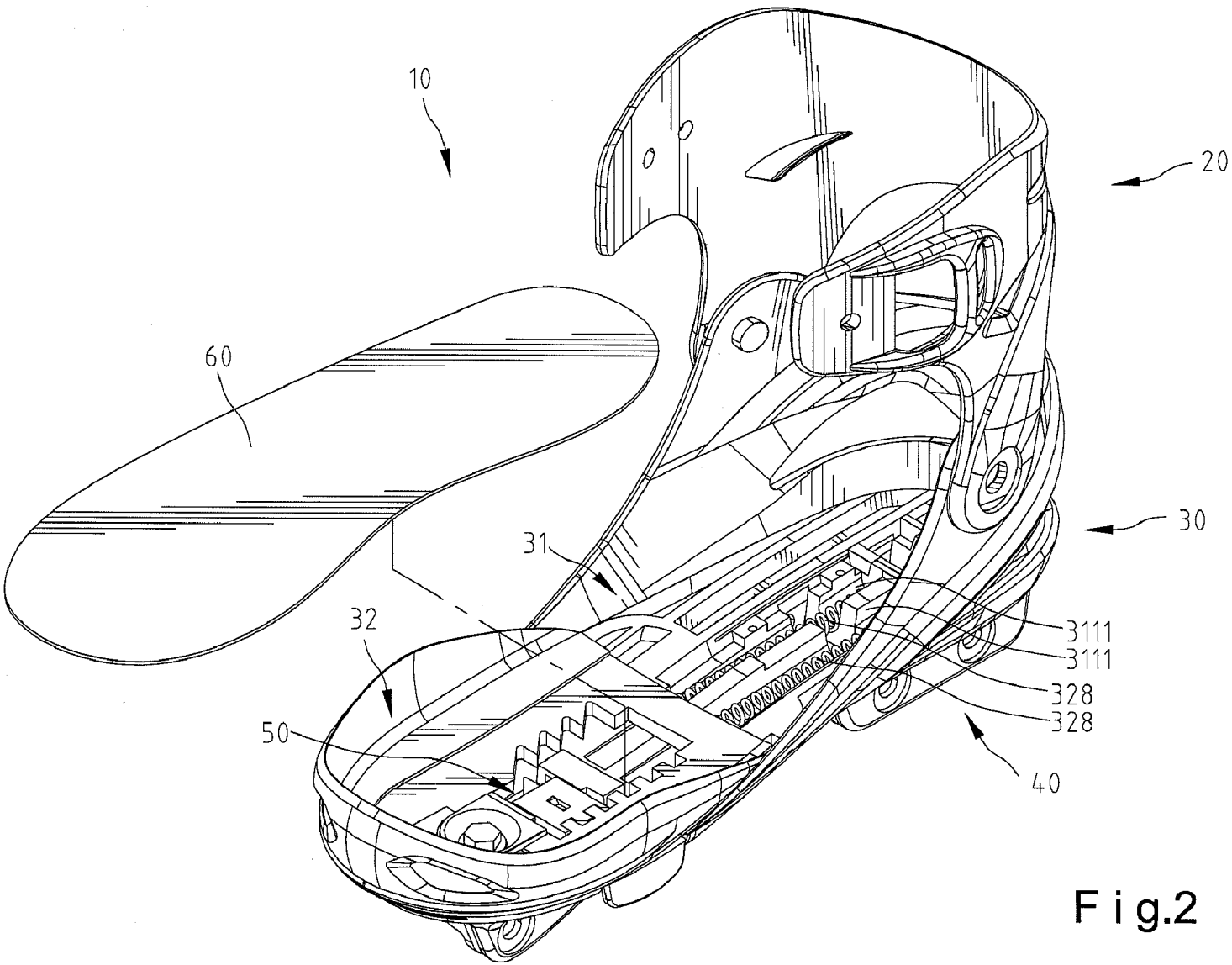
FIG. 2 is a partial, exploded view of the skate shown in FIG. 1.
Figure 3:
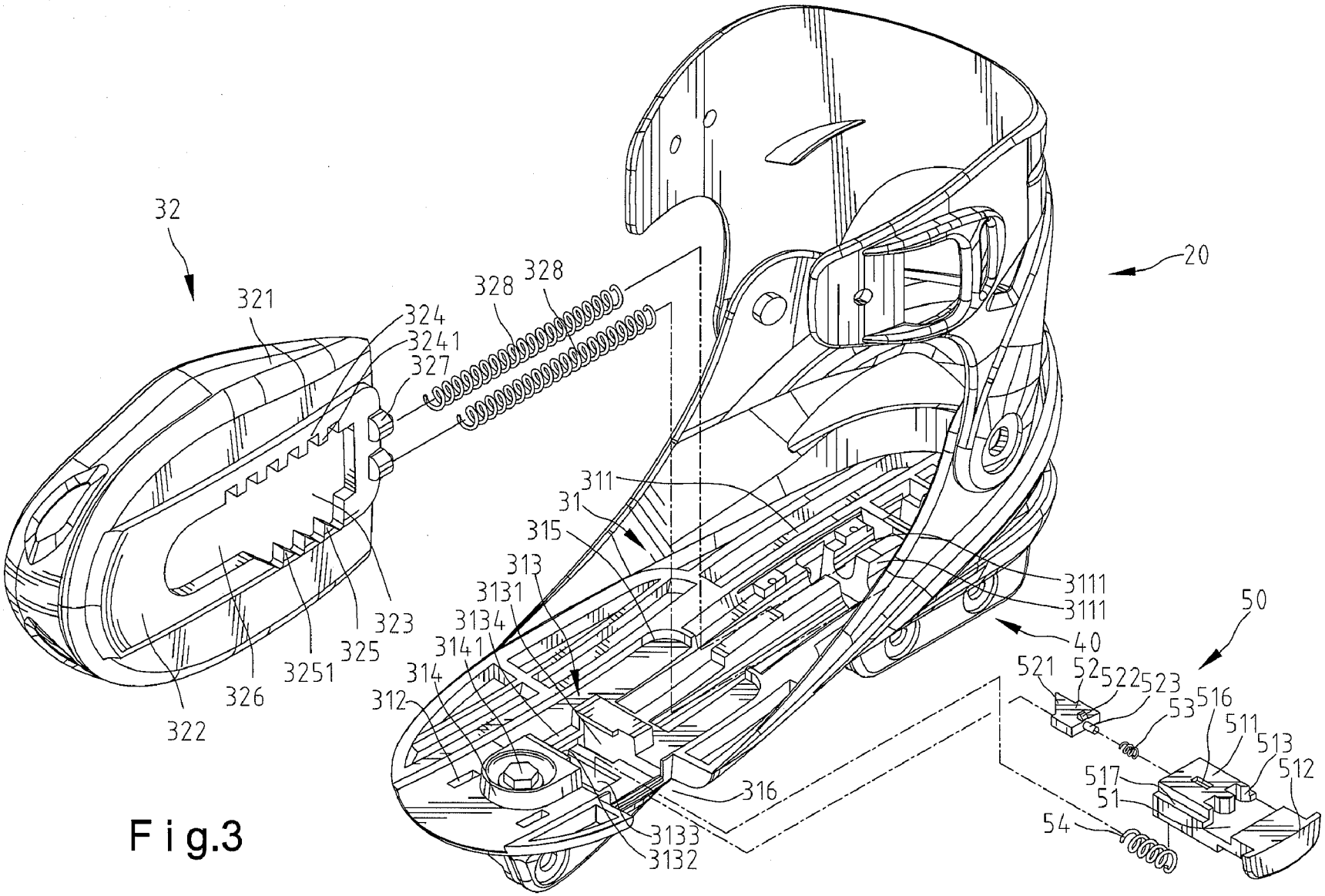
FIG. 3 is an exploded view of the skate shown in FIG. 1.
Figure 4:
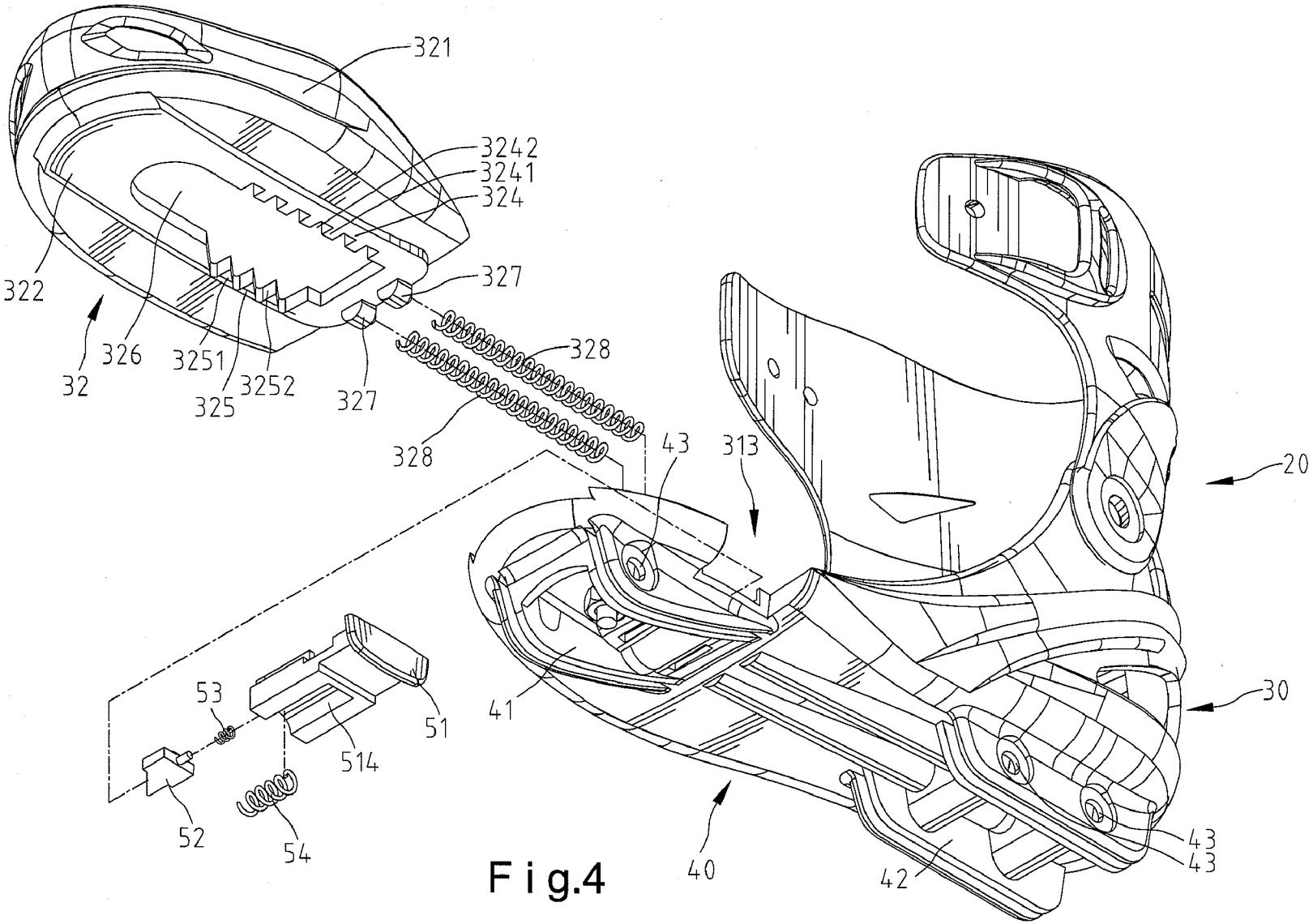
FIG. 4 is another exploded view similar to FIG. 3.
Figure 5:
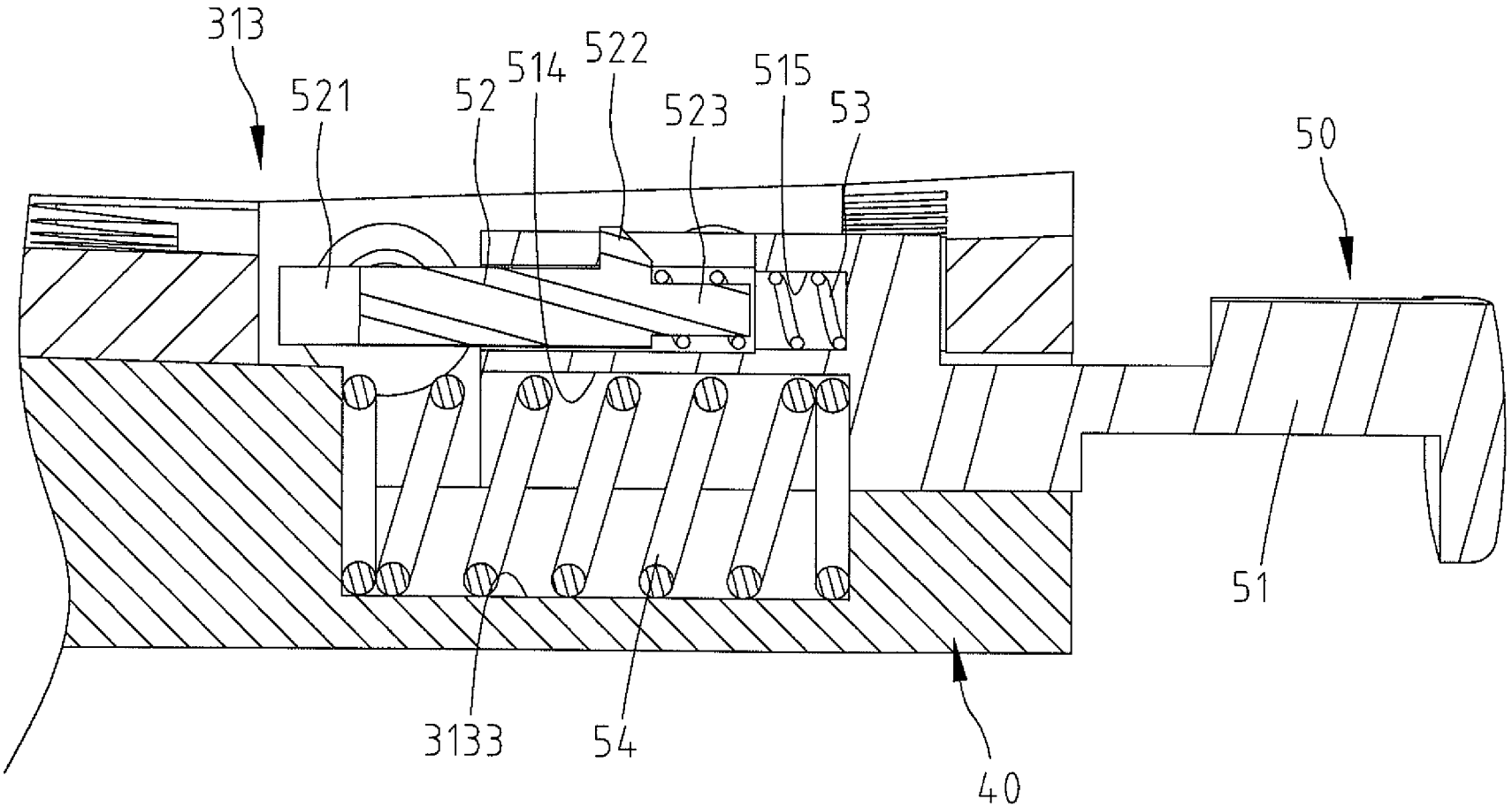
FIG. 5 is a partial, cross-sectional view of an adjustment unit and a soleplate member of the skate shown in FIG. 2.
Figure 6:
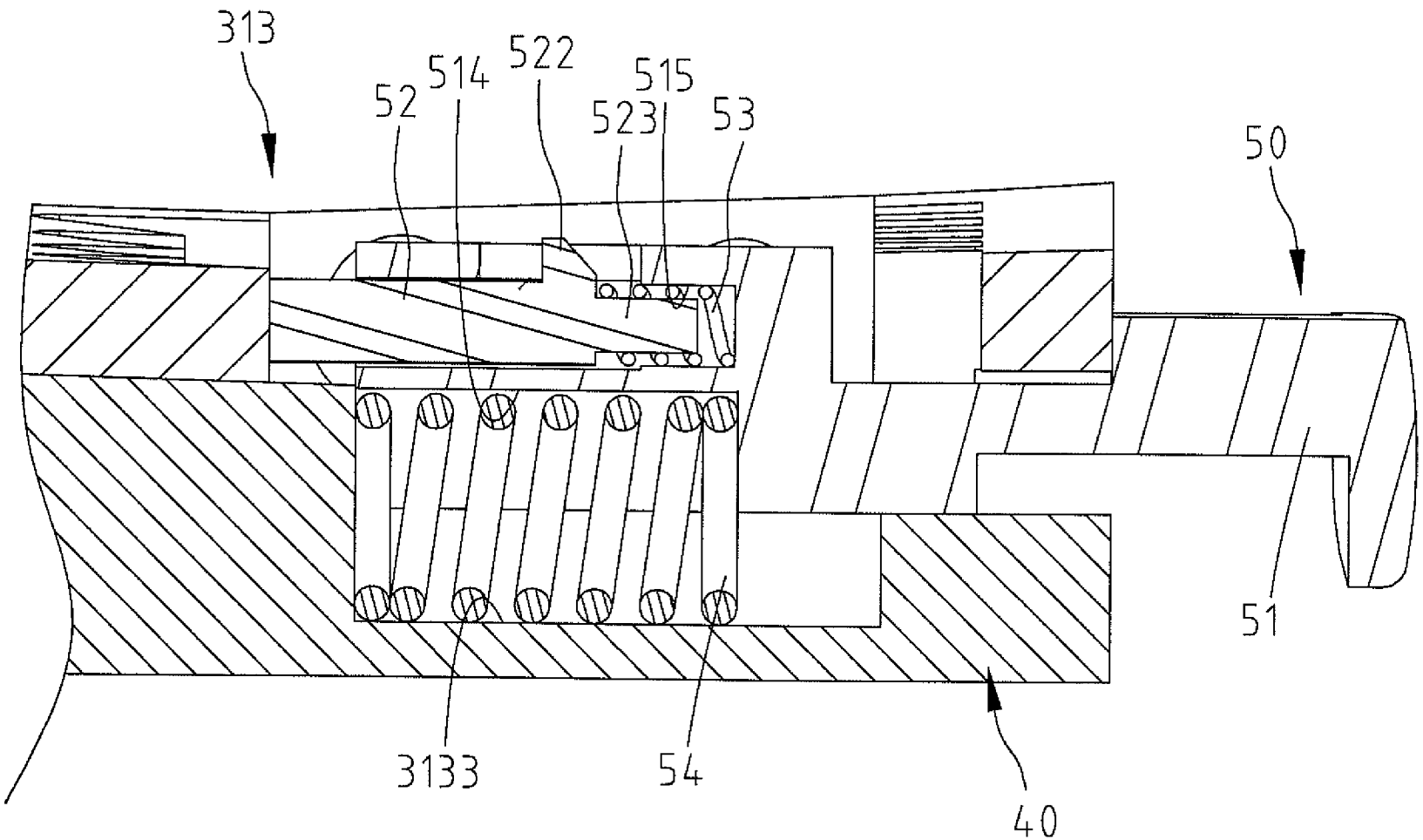
FIG. 6 is another cross-sectional view similar to FIG. 5.

With reference to the above figures, a skate 10 includes a cuff member 20, a soleplate member 30, a frame member 40 secured to the bottom of the soleplate member 30 and used to connect to wheels and an insole 60 overlaying the soleplate member 30. An adjustment unit 50 which is installed on the soleplate member 30 and hid above the insole 60 is adapted for adjusting size of the soleplate member 30. The frame member 40 includes frontward and rearward portions 41, 42 and numbers of wheel engaged holes 43 for coupling to wheels (not shown) of the skate 10.

The cuff member 20 is coupled to the soleplate member 30 and numbers of suitable fasteners and a conventional buckle are secured to the cuff member 20. Therefore, the cuff member 20 can be used to be securely fastened to leg of a wearer.

The soleplate member 30 whose size is modified in length and includes a heel support 31 where the cuff member 20 is coupled to and a toe support 32 overlappingly coupled to the heel support 31 opposite to the cuff member 20. The toe support 32 is adapted to slide with respect to the heel support 31 in a longitudinal axis and fixed in a desired position as to achieve a desired length of the soleplate member 30.

The heel support 31 includes a heel portion 311 adapted for supporting heel of the wearer and a tongue portion 312 integrally extending from the heel portion 311 opposite to the cuff member 20. A receiving portion 313 adapted to receive the adjustment unit 50, a stop 314 adapted to restrict the toe support 32 on the tongue portion 312 and a soleplate receptacle 315 adapted to receive the toe support 32 are formed on the tongue portion 312. An axis direction of the soleplate receptacle 315 is perpendicular to that of the receiving portion 313 and parallel to the heel support 31. An inlet portion 316 is defined at a side of the tongue portion 312 proximal to the adjustment unit 50 and where the adjustment unit 50 is inserted into the receiving portion 313.

The toe support 32 includes a border portion 321 provided to protect toes of the wearer and a slider 322 formed on the bottom thereof and slideably received in the soleplate receptacle 315. A space 323 pierces the center of the slider 322 and exposes the receiving portion 313 and the stop 314 therefrom. A receptacle 326 is formed on a side of the space 323 and proximal to the front of the toe support 32. A side of the stop 314 is preferably arcuate and corresponds to the profile of the receptacle 326. While the toe support 32 slides along the soleplate receptacle 315, the receptacle 326 is restricted by the stop 314 selectively. Further, a fastener 3141 is secured onto the stop 314 for coupling the soleplate member 30 to the frame member 40.

First side 324 and second side 325 are respectively defined on two sides of the space 323 and spaced from each other and the receiving portion 313 is sandwiched between the first and second sides 324, 325. First and second teeth 3241, 3251 are respectively formed on the first and second sides 324, 325. The first teeth 3241 are spaced from each other in constant spacing and preferably square and the second teeth 3251 are spaced from each other in constant spacing and preferably triangular. Two coupled projections 327 are formed from the rear of the toe support 32 toward the heel support 31. Two elastic elements 328 are received in two channels 3111, which are formed on the heel portion 311 and parallel to each other, and provided between the coupled projections 327 and an abutted portion 3112, which is defined on the heel portion 311 (shown in FIGS. 7 through 11). Moreover, the channels 3111 communicate the heel portion 311 and the soleplate receptacle 315 with each other so that the elastic elements 328 provide the toe support 32 an inward force with respect to the heel support 31. And the stop 314 prevents the toe support 32 disengaging from the soleplate receptacle 315 while the toe support 32 slides toward the heel support 31.

The adjustment unit 50 is received in the receiving portion 313 and consists of an insertion member 51, a wedge member 52 and first and second springs 53, 54.

The receiving portion 313 includes a first compartment 3131 providing the insertion member 51 slideably received therein, a flange 3132 abutted against a side of the insertion member 51 and a second compartment 3133 providing the second spring 54 received therein. The first compartment 3131 is formed on the soleplate member 30 and the second compartment 3133 is defined between the soleplate and frame members 30, 40 above the first compartment 3131. An axis direction of the insertion member 51 is parallel to the receiving portion 313 and perpendicular to the space 323. The wedge member 52 is provided between the second side 325 and the insertion member 51 and extends from a gap 3134 to wedge with the teeth 3251, and the detailed description of the arrangement of the adjustment unit 50 and the toe support 32 will discussed in follows.

The insertion member 51 includes a first end 511 coupled to the wedge member 52 and a second end 512 operated by the wearer to push the insertion member 51 inward with respect to the soleplate member 30. Teeth 513 are formed between the first and second ends 511, 512 and engaged with the first teeth 3241 of the toe support 32. A first receiving hole 514 is formed on the bottom of the insertion member 51 for receiving the second spring 54. The second spring 54 provides the insertion member 51 an outward force with respect to the soleplate member 30. A second receiving hole 515 is defined at the distal of the first end 511 and opened toward the wedge member 52. The first spring 53 is received in the second receiving hole 515 between the insertion and wedge members 51, 52 and provides the wedge member 52 an outward force with respect to the insertion member 51. A rail 517 is provided on a side of the first end 511 and corresponds to the flange 3132 of the receiving portion 313 so that the insertion member 51 cab slide with respect to the receiving portion 313 in a smooth manner.

In this case, the first spring 53 is much smaller than the second spring 54 and the weight of the insertion member 51 is much larger than that of the wedge member 52 so that an elastic force of the first spring 53 makes a greater impact on the wedge member 52 than the insertion member 51. In addition, an elastic force of the second spring 54 makes a greater impact on the insertion member 51 than that of the whole skate 10.

The wedge member 52 includes a wedging end 521 selectively engaged with the second teeth 324, a coupled end 523 coupled to the first spring 53 opposite to the wedging end 521 and an engaging portion 522 formed on the top thereof and proximal to the coupled end 523. In this case, the wedging end 521 is in form of a triangular tooth and corresponds to each of the second teeth 3251. While the insertion and wedge members 51, 52 interconnect, the coupled end 523 is inserted into the second receiving hole 515 and the engaging portion 522 is coupled to an engaging slot 516. The engaging portion 522 is able to slide along the engaging slot 516 and the first spring 53 is pressed between the insertion and wedge members 51, 52 while the insertion member 51 is pushed toward the wedge member 52. After loosening the insertion member 51, the first spring 53 is released and presses the wedge member 52 toward the second side 325.

Figure 7:
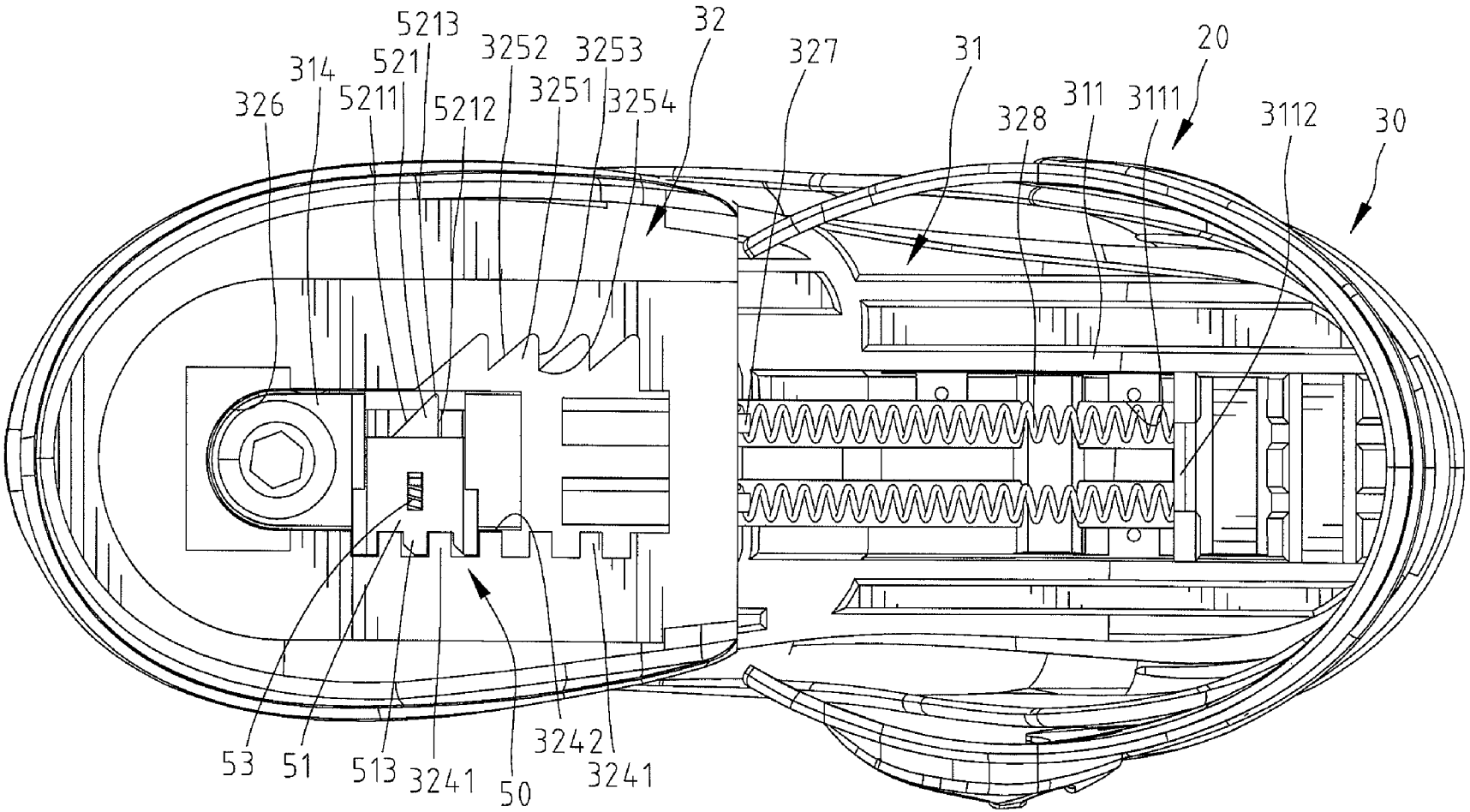
FIG. 7 is a top view of the skate shown in FIG. 2.

Referring to FIG. 7 particularly, it shows that the length size of the soleplate member 30 is smallest and the adjustment unit 50 is in an idle position. The teeth 513 are wedged with several of the first teeth 3241, the wedging end 521 is disengaged with the second teeth 3251, and the stop 314 is coupled to the receptacle 326. Spacing between each of the teeth 513 corresponds to the spacing between the first teeth 3241. The wedging end 521 has an inclined side 5211 and a straight side 5212 and each of the second teeth 3251 has an inclined side 3252 selectively abutted with the inclined side 5211 and a straight side 3253 selectively abutted with the straight side 5212.

Figure 8:
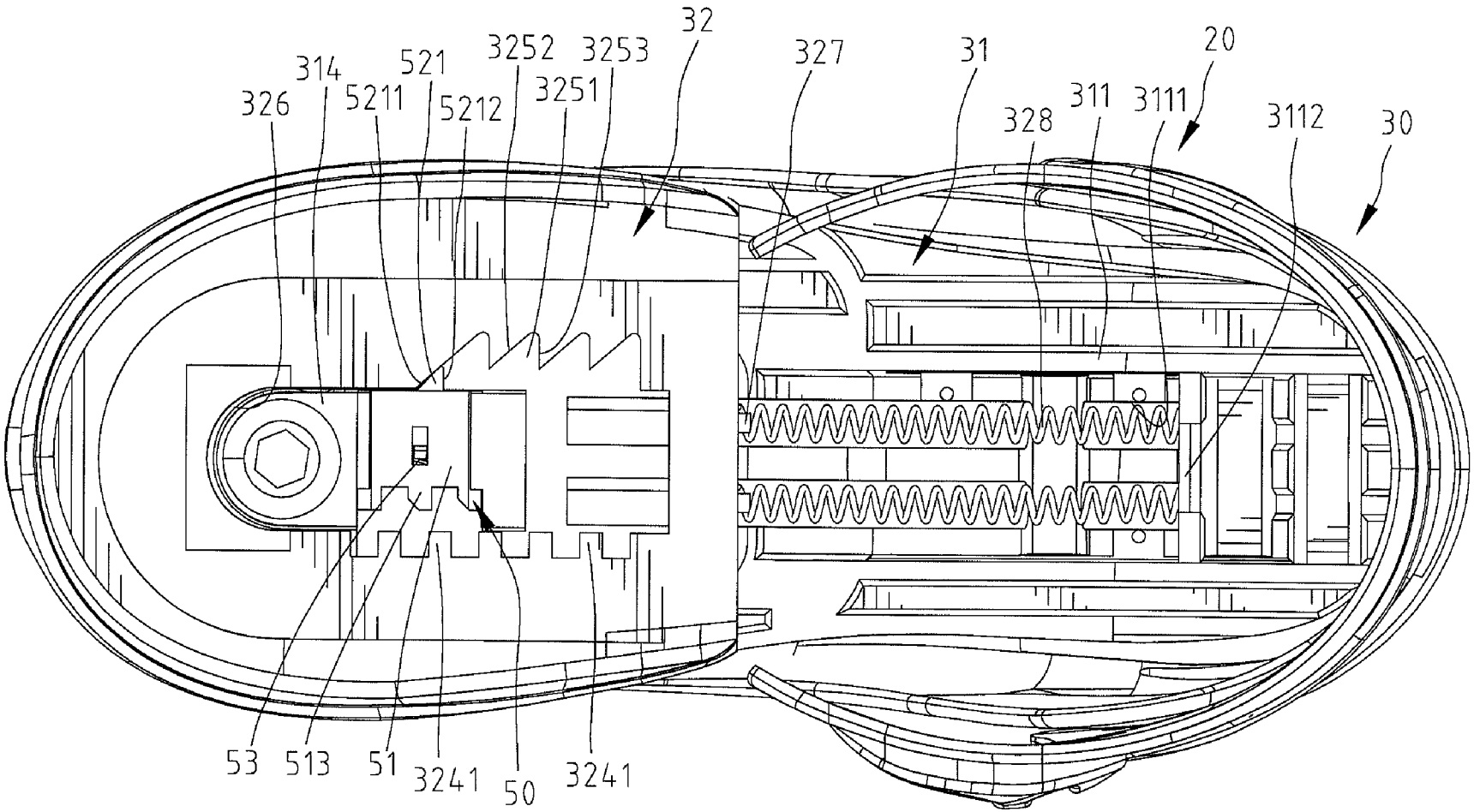
FIG. 8 is another top view of the skate similar to FIG. 7.
Figure 9:
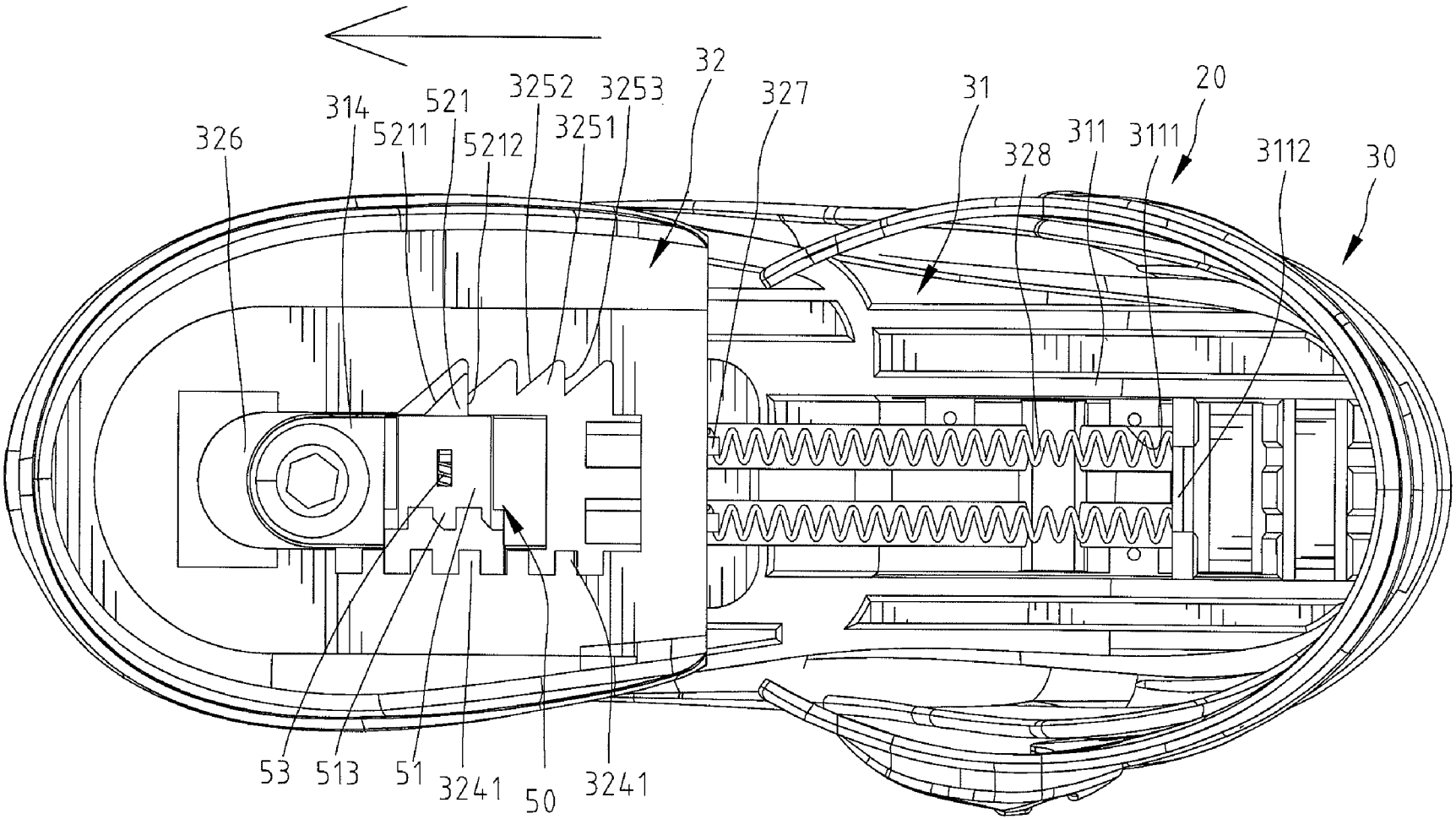
FIG. 9 is yet another top view of the skate similar to FIG. 7.

Referring to FIG. 8 particularly, it shows that the insertion member 51 is pressed toward the wedge member 52 and the adjustment unit 50 is in an operative position for adjusting the length size of the soleplate member 30. The teeth 513 are disengaged from the first teeth 3241 and the inclined side 5211 of the wedging end 521 is abutted with the inclined side 3252 of one of the second teeth 3251 so that the toe support 32 is able to slide with respect to the heel support 31. Further referring FIG. 9, while operating the toe support 32 away from the heel support 31, the straight side 5212 of the wedging end 521 is driven to abut with the straight side 3253 by the elastic elements 328. In the same time, the teeth 513 exactly align to numbers of the first teeth 3241 and it avoids a mismatch between the teeth 513 and the first teeth 3241.

Figure 10:
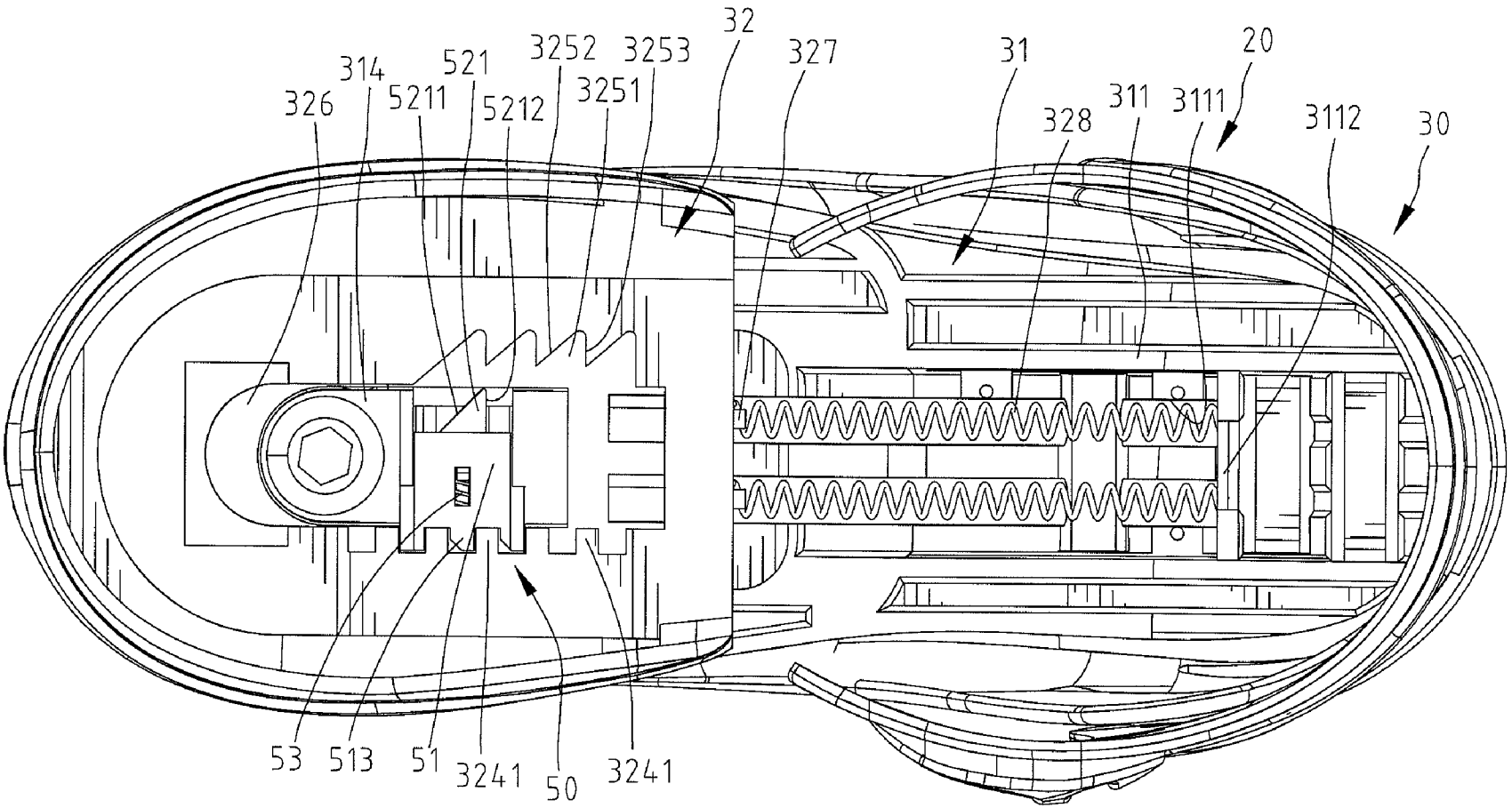
FIG. 10 is yet another top view of the skate similar to FIG. 7.
Figure 11:
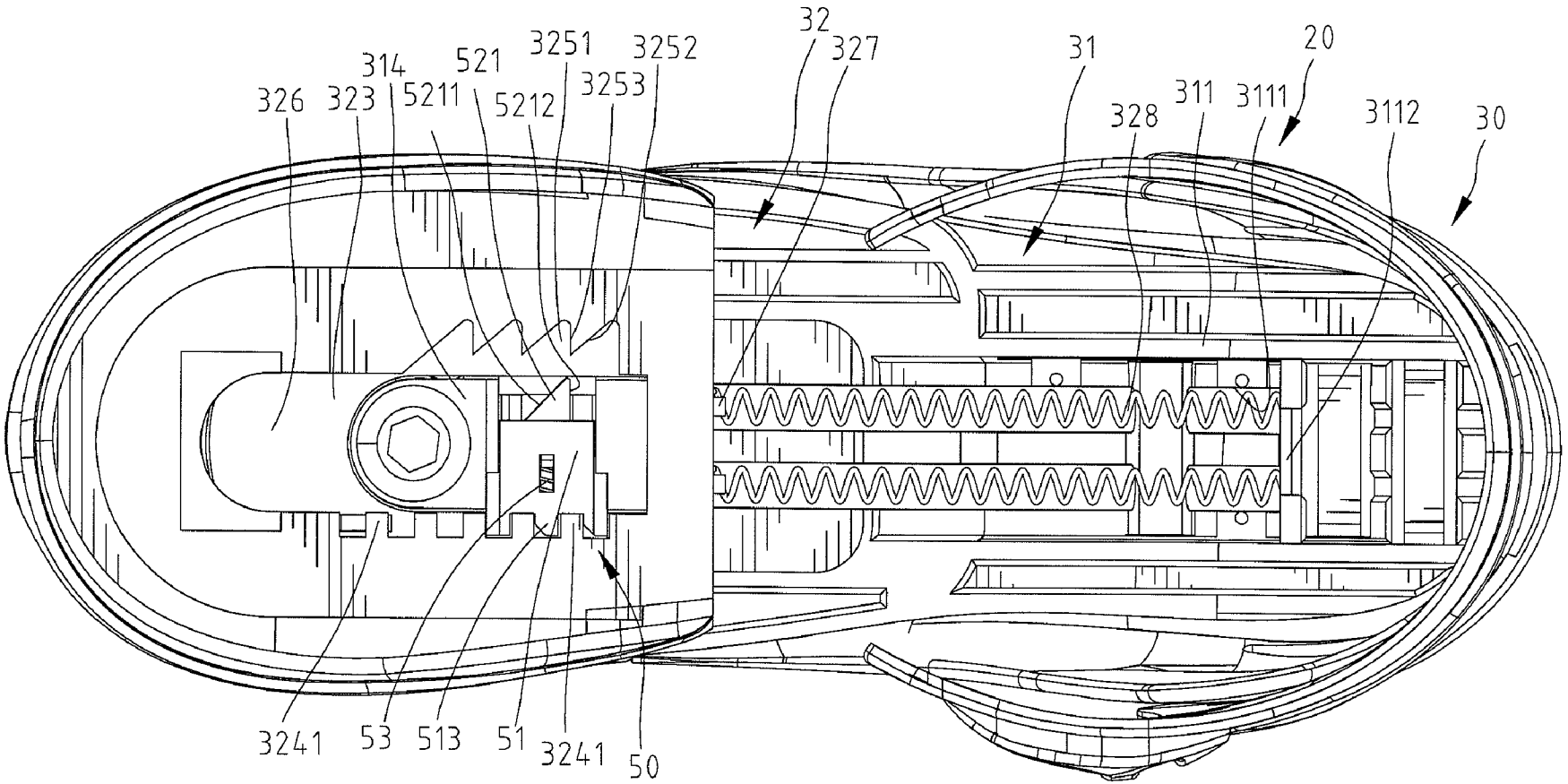
FIG. 11 is yet another top view of the skate similar to FIG. 7.

Referring to FIG. 10 particularly, it shows that the adjustment unit 50 is loosened to be back to the idle position and the teeth 513 are wedged with the desired numbers of the first teeth 3241. While the toe support 32 is driven to be in position and the adjustment unit 50 is loosened, the second spring 54 is released to press the insertion member 51 outwardly as to wedge the teeth 513 with the first teeth 3241. Finally, the toe support 2 is operated to be in position with respect to the heel support 51. Referring to FIG. 11, it shows that that the length size of the soleplate member 30 is largest and the adjustment unit 50 is in the idle position.

In addition, a teeth tip 3254 which is defined by the straight side 3253 of one second tooth 3251 and the inclined side 3252 of the neighbor one tooth 3251 aligns the center of a teeth surface 3242 of each first tooth 3241. Therefore, while the teeth 513 of the adjustment unit 50 are driven to be in position with respect to the second teeth 3252, a tip 5213 of the wedging end 521 would not be in contact with the teeth tip 3254.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A skate comprising:

a cuff member;

a soleplate member including a heel support and a toe support overlapping and adapted to slide with respect to the heel support in a longitudinal axis and fixed in a desired position as to achieve a desired length of the soleplate member;

wherein the toe support includes first and second teeth spaced from each other;

an adjustment unit including teeth adapted to selectively wedge with the first teeth and a wedging end adapted to selectively wedge with the second teeth; and wherein while the adjustment unit is in an idle position, the teeth are wedged with several of the first teeth, the wedging end is disengaged with the second teeth;

wherein while the adjustment unit is in an operative position for adjusting the length size of the soleplate member, the teeth are disengaged from the first teeth so that the toe support is able to slide with respect to the heel support.

2. The skate as claimed in claim 1, wherein a teeth tip is defined by each two of the second teeth and aligns the center of a teeth surface of each first tooth; wherein while the teeth are driven to be in position with respect to the second teeth, a tip of the wedging end would not be in contact with the teeth tip.

3. The skate as claimed in claim 1, further comprising numbers of elastic elements between the heel and toe supports and providing the toe support an inward force with respect to the heel support.

4. The skate as claimed in claim 2, further comprising numbers of elastic elements between the heel and toe supports and providing the toe support an inward force with respect to the heel support.

5. The skate as claimed in claim 1, further comprising a receiving portion adapted to receive the adjustment unit, a stop adapted to restrict the toe support on the heel support and a soleplate receptacle adapted to receive the toe support.

6. The skate as claimed in claim 3, further comprising a receiving portion adapted to receive the adjustment unit, a stop adapted to restrict the toe support on the heel support and a soleplate receptacle adapted to receive the toe support.

7. The skate as claimed in claim 4, further comprising a receiving portion adapted to receive the adjustment unit, a stop adapted to restrict the toe support on the heel support and a soleplate receptacle adapted to receive the toe support.

8. The skate as claimed in claim 5, wherein the heel support includes a heel portion adapted for supporting heel of a wearer and a tongue portion integrally extending from the heel portion opposite to the cuff member; wherein the receiving portion, the stop and the soleplate receptacle are formed on the tongue portion.

9. The skate as claimed in claim 7, wherein the adjustment unit is received in the receiving portion and consists of an insertion member, a wedge member and first and second springs; wherein the teeth defined on the insertion member and the wedging end defined on an end of the wedge member; wherein the first spring is provided between the insertion and wedge members and the second spring is provided between the insertion member and the soleplate member.

10. The skate as claimed in claim 8, wherein the adjustment unit is received in the receiving portion and consists of an insertion member, a wedge member and first and second springs; wherein the teeth defined on the insertion member and the wedging end defined on an end of the wedge member; wherein the first spring is provided between the insertion and wedge members and the second spring is provided between the insertion member and the soleplate member.

11. The skate as claimed in claim 1, wherein spacing between each of the teeth corresponds to the spacing between the first teeth; wherein the wedging end has an inclined side and a straight side and each of the second teeth has an inclined side selectively abutted with the inclined side and a straight side selectively abutted with the straight side.

12. The skate as claimed in claim 11, wherein when the adjustment unit is in the operative position the teeth are disengaged from the first teeth and the inclined side of the wedging end is abutted with the inclined side of one of the second teeth so that the toe support is able to slide with respect to the heel support.

13. The skate as claimed in claim 12, wherein while operating the toe support away from the heel support, the straight side is driven to abut with the straight side by the elastic elements and the teeth exactly align to numbers of the first teeth and it avoids a mismatch between the teeth and the first teeth.

* * * * *